US006659841B2

(12) United States Patent
Raimondo

(10) Patent No.: US 6,659,841 B2
(45) Date of Patent: Dec. 9, 2003

(54) NURSING BRA

(76) Inventor: Rick A. Raimondo, 8 Larsen Park Dr., Medford, NJ (US) 08055

( * ) Notice: Subject to any disclaimer, the term of this patent is extended or adjusted under 35 U.S.C. 154(b) by 0 days.

(21) Appl. No.: 10/145,865

(22) Filed: May 10, 2002

(65) Prior Publication Data

US 2003/0211810 A1 Nov. 13, 2003

(51) Int. Cl.[7] ..... A41C 3/00
(52) U.S. Cl. ..... 450/36; 450/37; 604/388
(58) Field of Search ..... 450/36, 37, 54–57, 450/89, 81, 88; 2/267, 268, 104, 73, 113; 128/890; 604/385.07, 386, 387, 388, 393

(56) References Cited

U.S. PATENT DOCUMENTS

| | | | | | |
|---|---|---|---|---|---|
| 1,136,727 | A | * | 4/1915 | Smith | 450/36 |
| 1,664,214 | A | * | 3/1928 | Hudson | 450/36 |
| 1,989,382 | A | | 1/1935 | Schnaittacher | |
| 2,121,088 | A | * | 6/1938 | La Rue | 450/36 |
| 2,502,524 | A | | 4/1950 | Keller | |
| 2,522,010 | A | * | 9/1950 | Woodruff | 450/36 |
| 2,627,606 | A | * | 2/1953 | De Grandis | 2/267 |
| 2,679,048 | A | * | 5/1954 | Alberts | 450/36 |
| 2,698,940 | A | * | 1/1955 | Dombek | 450/36 |
| 3,115,141 | A | * | 12/1963 | Means et al. | 450/36 |
| 3,701,168 | A | * | 10/1972 | Balow | 450/36 |
| 3,763,865 | A | * | 10/1973 | Defru | 450/36 |
| 6,074,273 | A1 | | 6/2001 | Turner | |
| 6,257,952 | B1 | * | 7/2001 | Valentin | 450/81 |
| 6,319,092 | B1 | | 11/2001 | Leyhe | |

* cited by examiner

*Primary Examiner*—Gloria M. Hale
(74) *Attorney, Agent, or Firm*—Stuart M. Goldstein

(57) ABSTRACT

A pair of bra cups formed as a single, molded layer, each cup having a inner surface and an outer surface. An opening extends between the inner and outer surfaces of each cup at the location of the wearer's nipples. Each cup has a pocket positioned over and secured to the inner surface of the cup. The pocket overlays approximately one-half of the inner surface, but does not cover any part of the opening. An absorbent, replaceable nursing pad is positioned and retained within each pocket. The pad serves to cover the opening when in place in the pocket, but is removable from the pocket when nursing is completed. This nursing bra configuration is readily adaptable for use with a variety of bra to body attachment and support devices. The design obviates the need for flaps attached with snaps or hooks and thus facilitates unobstructed nursing. In addition, backless and strapless designs allow the user to wear the bra with fashionable dresses and blouses.

34 Claims, 2 Drawing Sheets

NURSING BRA

BACKGROUND OF INVENTION

There are numerous nursing bra designs which have attempted to provide a sanitary environment for the breast feeding of newborn children and in order to ensure for the cleanliness of the mothers' outer apparel, as well as of the bra itself. Other nursing bra designs have sought to allow a measure of convenience to the mother, by permitting her to nurse her child without the need to remove the entire bra.

For instance, the bra disclosed in U.S. Pat. No. 1,989,382 provides for an absorbent pad which is positioned within the bra cup near the nipple area, to absorb excess milk flow and prevent soiling of clothing. U.S. Pat. No. 6,074,273 also discloses the use of a pad, in this case placed within a removable section of the bra which must be detached from the main body of the bra when nursing is desired. By this design, the mother's blouse or shirt must be substantially removed in order to begin nursing.

Neither of these representative patents, nor any prior nursing bra design is especially convenient to the nursing process. Prior nursing bras do not function without compelling the mother to partially disrobe or unhook or detach all or part of the bra. This results in difficulty during nursing, both for the mother and the infant, who may be distracted and bothered by detached clothing. The sanitary nature of the process is also compromised, as is the increased likelihood that the mother's clothing and the bra itself will become wet and stained.

SUMMARY OF THE PRESENT INVENTION

It is thus an object of the present invention to provide a nursing bra which overcomes the limitations and disadvantages of prior nursing bras.

It is an object of the present invention to provide a nursing bra which provides the nursing mother and her infant child a sanitary environment during the nursing process.

It is a further object of the present invention to provide a nursing bra which provides the nursing infant ready and unencumbered access to the mother.

It is another object of the present invention to provide a nursing bra which allows the nursing mother an easy, convenient and comfortable means to nurse her child.

It is still another object of the present invention to provide a nursing bra which allows use of the bra without the need of the mother to disrobe or remove the bra.

It is still a further object of the present invention to provide a nursing bra which allows the bra to be used without unhooking, detaching, or disconnecting the bra in any manner.

It is another object of the present invention to provide a nursing bra which can be designed to readily accommodate different nipple configurations, locations and sizes and allow for varied nursing positions.

It is still another object of the present invention to provide a nursing bra which can be adopted for use with a variety of bra to body attachment and support means.

It is another object of the present invention to provide a nursing bra which can be combined with a variety of backless and strapless designs, to allow the user to wear fashionable dresses and blouses.

It is a further object of the present invention to provide a nursing bra which will avoid leakage and staining and fading of clothing caused by moisture during nursing.

The objectives outlined above and many others are accomplished by the nursing bra of the present invention which comprises a pair of bra cups formed as a single, molded layer, each cup having a inner surface and an outer surface. An opening extends between the inner and outer surfaces of each cup at the location of the wearer's nipples. Each cup has a pocket positioned over and secured to the inner surface of the cup. The pocket overlays approximately one-half of the inner surface, but does not cover any part of the opening. An absorbent, replaceable nursing pad is positioned and retained within each pocket. The pad serves to cover the opening when in place in the pocket, but is removable from the pocket when nursing is completed. This nursing bra configuration is readily adaptable for use with a variety of bra to body attachment and support means. The design obviates the need for flaps attached with snaps or hooks and thus facilitates unobstructed nursing. In addition, backless and strapless designs allow the user to wear the bra with fashionable dresses and blouses.

The novel features which are considered as characteristic of the invention are set forth in particular in the appended claims. However, both as to their design, construction, and use, together with additional features and advantages thereof, they are best understood upon review of the following detailed description with reference to the accompanying drawings.

DETAILED DESCRIPTION OF THE INVENTION

Figure 1:
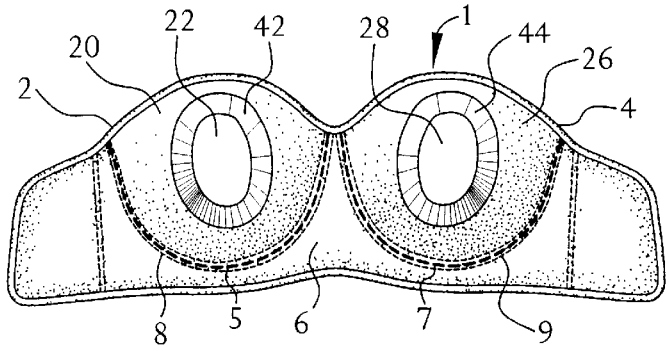
FIG. 1 shows the front view of the nursing bra of the present invention without the nursing pads inserted in place.
Figure 2:
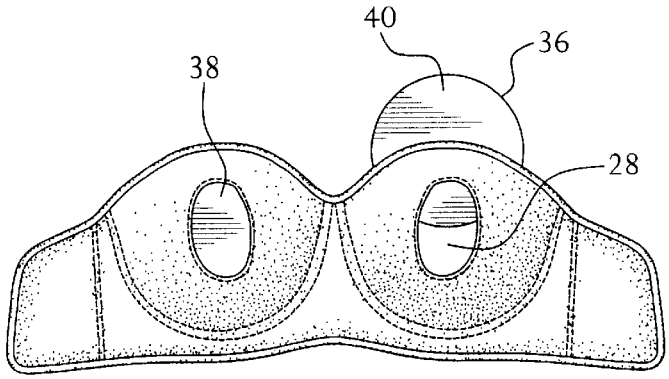
FIG. 2 shows the front view of the nursing bra of the present invention with nursing pads inserted and positioned to be inserted in place.
Figure 3:
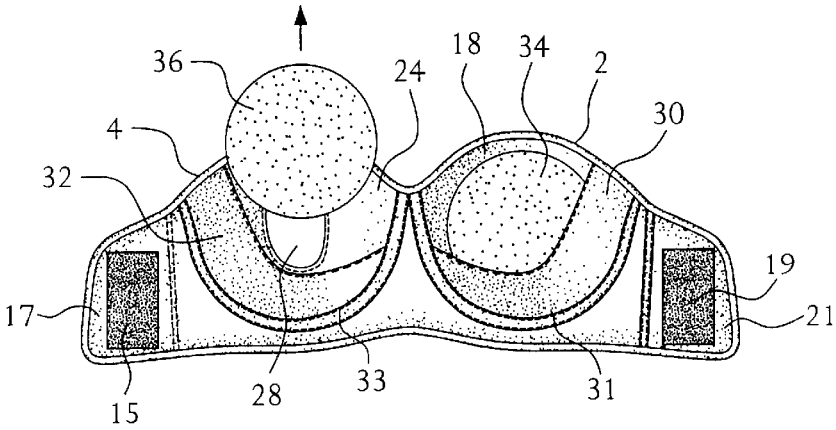
FIG. 3 shows the rear view of the nursing bra of the present invention with nursing pads inserted and positioned to be in place.
Figure 4:
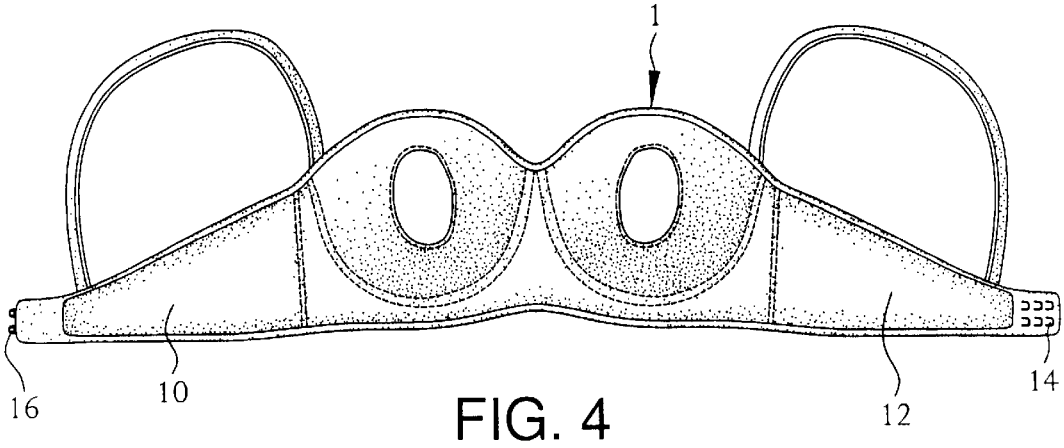
FIG. 4 shows a front view of the nursing bra of the present invention in use with a detachable back strap and shoulder straps.
Figure 5:
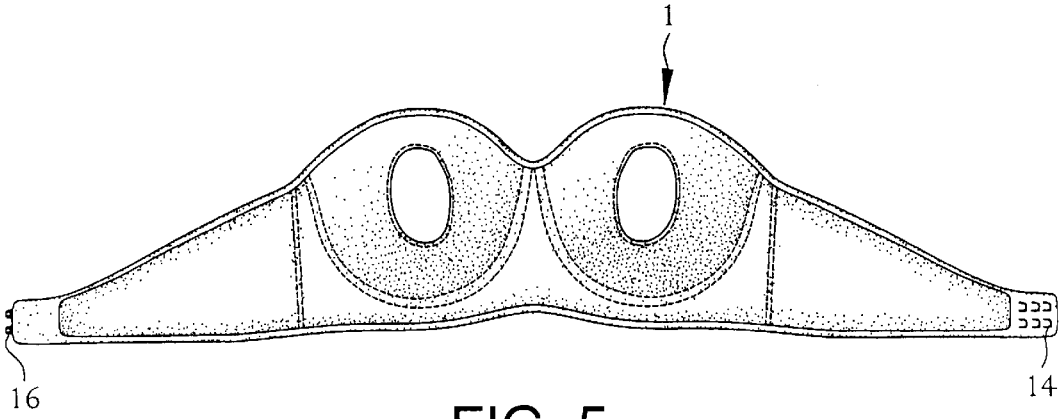
FIG. 5 shows a front view of the nursing bra of the present invention in use as a strapless bra.

Nursing bra 1 comprises bra cups 2 and 4, each formed as a single layer, preferably of molded material construction which is known in the art. Cups 2 and 4 are secured to bra panel 6 by sewed connection 8 and 9 respectively, or by other commonly used means. Underwire supports 5 and 7 are provided for cups 2 and 4. Bra 1 is shown in FIG. 4 with standard back straps 10 and 12, to be secured by hook and eye connection 14 and 16. FIG. 5 shows bra 1 being used with a strapless connection, secured by hook and eyes 14 and 16. However, it is contemplated that the nursing bra configuration described herein can be used with a variety of bra to body attachment and support designs. Such designs further include, but are not limited to, bras with clear back bands, bras with detachable straps, and bras without a back or straps, using short side wing or tab sections 17 and 21 and adhesive pads 15 and 19, such as is shown as seen in FIG. 3.

Bra 1 of the present invention comprises cup 2 inner surface 18 and outer surface 20 with opening 22 extending therethrough. Cup 4 has inner surface 24 and outer surface 26 with opening 28 extending therethrough. Pocket receptacle members 30 and 32 are secured at their lower edges by sewed connection 31 and 33 or similar means, to inner surfaces 18 and 24 respectively. Pockets 30 and 32 are open at their top edges to receive absorbent nursing pads 34 and 36. Pockets 30 and 32 are configured to overlay approximately one-half of inner surfaces 18 and 24, but are positioned such that openings 22 and 28 at all times remain uncovered by the pockets.

Absorbent nursing pads 34 and 36, made of cotton or other moisture absorbing material, are configured to be inserted into pockets 30 and 32 respectively. When in place, pads 34 and 36 completely cover openings 22 and 28 and so cover and comfortably protect the wearer's nipples, since it is the soft, cotton interior surface of the pads which comes in contact with the breast. Outer surfaces 38 and 40 of pads 34 and 36 comprise a thin layer of soft, impermeable, pliable, plastic or plastic-like material to prevent leakage from the cotton absorbent material of the pads through to the wearer's clothing. Pads 34 and 36 are designed to be disposable and are to be replaced when they become saturated, stained, or lose absorbency. Alternatively pads 34 and 36 may be of washable material, so they can be reused. The pliable plastic material which is used on surfaces 38 and 40 is also used for protective rims 42 and 44, which surround openings 22 and 28. Rims 42 and 44 are designed to keep the cloth area of cups 2 and 4 dry and to prevent staining during the nursing process, when residual moisture may come through openings and leak onto the outer surface of the cups. Any moisture on plastic rims 42 and 44 can readily be wiped cleaned.

It is further contemplated that the size of openings 22 and 28 is large enough not to restrict nursing and to accommodate different nipple configurations, sizes and locations. The shape of the openings can also be varied to accommodate different nursing positions.

In use, bra 1 is normally worn with nursing pads 34 and 36 in place within pockets 30 and 32 of cups 2 and 4, respectively. When nursing is desired, the mother's nipple may be exposed simply by removing either of pads 34 and 36. No unhooking, detaching, or disconnecting of bra 1 or any apportion thereof is necessary. The infant is able to nurse directly from the nipple, without any encumbrances or obstacles presented by detachable sections of the bra and, since they do not cover openings 22 and 28, without interference from pockets 30 and 32 or any other part of the bra. Plastic or plastic-like rims 42 and 44 prevent excess milk from the breast or moisture from the child to drip onto and wet or stain the bra cups.

After nursing is completed, nursing pads 34 and 36 are reinserted into their respective pockets 30 and 32. The soft, cotton material inner sections of pads 34 and 36 absorb excess moisture from the nipple, while plastic outer surfaces 38 and 40 prevent any leakage or moisture from going through the pads to clothing.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

I claim:

1. A nursing bra comprising:

a. a pair of bra cups, each bra cup formed as an integral, non-separable cup shaped element, and each comprising an inner surface and an outer surface, said cups each comprising an opening substantially sized to expose only the nipple area of the wearer, said opening extending through each cup between the inner and outer surfaces only at the approximate location of the nipple area;

b. means connected to the bra cups for securing the bra to and over the breast of a woman;

c. a removably insertable nursing pad;

d. receptacle means connected directly to each of the respective inner surfaces of the bra cups for insertion of the nursing pad, to retain the nursing pad within the receptacle means substantially over the nipple area, and to allow the removal of the pad without unhooking, removing, or in any manner disconnecting any part of the nursing bra, the openings at all times remaining uncovered by the receptacle means.

2. The nursing bra as in claim 1 wherein the means connected to the bra cups comprises back and shoulder straps.

3. The nursing bra as in claim 1 wherein the means connected to the bra cups comprises a detachable back strap.

4. The nursing bra as in claim 1 wherein the means connected to the bra cups comprises shoulder straps.

5. The nursing bra as in claim 1 wherein the means connected to the bra cups comprises body adherent side tabs.

6. The nursing bra as in claim 1 in which the nursing pad comprises an inner and outer surface, wherein the outer surface is a soft, pliable, plastic like material.

7. The nursing bra as in claim 1 wherein the outer surface of each bra cup comprises a soft, pliable, plastic like material located around the perimeter of each respective opening.

8. The nursing bra as in claim 1 wherein the receptacle means overlays approximately one-half of the inner surfaces of each bra cup.

9. The nursing bra as in claim 1 in which the receptacle means comprises a pocket connected to each bra cup.

10. A nursing bra comprising:

a. a pair of bra cups, each bra cup formed as an integral non-separable cup-shaped element, and each comprising a single, layer having an inner surface and an outer surface, said cups each comprising an opening substantially sized to expose only the nipple area of the wearer, said opening extending between the inner surface and the outer surface only at the approximate location of the nipple area;

b. means connected to the bra cups for securing the bra to and over the breasts of a woman;

c. a removably insertable nursing pad;

d. receptacle means for removable insertion of the nursing pad and retention of the nursing pad substantially over the nipple area, said receptacle means being located and secured over a portion of each of the receptive inner surfaces of the bra cups, the openings at all times remaining uncovered by the receptacle means.

11. The nursing bra as in claim 10 wherein the means connected to the bra cups comprises back and shoulder straps.

12. The nursing bra as in claim 10 wherein the means connected to the bra cups comprises a detachable back strap.

13. The nursing bra as in claim 10 wherein the means connected to the bra cups comprises shoulder straps.

14. The nursing bra as in claim 10 wherein the means connected to the bra cups comprises body adherent side tabs.

15. The nursing bra as in claim 10 in which the nursing pad comprises an inner and outer surface, wherein the outer surface is a soft, pliable, plastic like material.

16. The nursing bra as in claim 10 wherein the outer surface of each bra cup comprises a soft, pliable, plastic like material located around the perimeter of each respective opening.

17. The nursing bra as in claim 10 wherein the receptacle means overlays approximately one-half of the inner surfaces of each bra cup.

18. The nursing bra as in claim 10 in which the receptacle mans comprises a pocket connected to each bra cup.

19. The nursing bra comprising:

a. a pair of bra cups, each bra cup formed as an integral non-separable cup-shaped element and each comprising an inner surface and an outer surface, said cups each comprising an opening substantially sized to expose only the nipple area of the wearer, said opening extending between the inner and outer surfaces only at the approximate location of the nipple area;

b. means connected to the bra cups for securing the bra to and over breasts of a woman;

c. a removably insertable nursing paid;

d. two pockets, one pocket positioned over the inner surface of each cup, each pocket comprising upper and lower edges, the lower edges of each pocket being attached to the inner surface of its respective cup and the upper edge being open in order to receive the nursing pad and for retaining the nursing pad in the pocket and substantially the nipple area, the openings at all times remaining uncovered by the pockets.

20. The nursing bra as in claim 19 wherein the means connected to the bra cups comprises back and shoulder straps.

21. The nursing bra as in claim 19 wherein the means connected to the bra cups comprises a detachable back strap.

22. The nursing bra as in claim 19 wherein the means connected to the bra cups comprises shoulder straps.

23. The nursing bra as in claim 19 wherein the means connected to the bra cups comprises body adherent side tabs.

24. The nursing bra as in claim 19 in which the nursing pad comprises an inner and outer surface, wherein the outer surface is a soft, pliable, plastic like material.

25. The nursing bra as in claim 19 wherein the outer surface of each bra cup comprises a soft, pliable, plastic like material located around the perimeter of each respective opening.

26. The nursing bra as in claim 19 wherein the pockets overlay at least approximately one-half of the inner surface of each bra cup.

27. A nursing bra comprising:

a. a pair of bra cups, each bra cup formed as an integral, non-separable cub-shaped element, and each comprising an inner surface and an outer surface, said cups each comprising an opening substantially sized to expose only the nipple area of the wearer, said opening extending between the inner and outer surfaces only at the approximate location of the nipple area;

b. means connected to the bra cups for securing the bra to and over breasts of a woman;

c. a removably insertable nursing pad;

d. means overlaying the inner surface of each cup for covering approximately one-half of the inner surface of each said cup, said means being secured to the inner surface of each cup and being opened along an upper edge to form a pocket over the inner surface for retaining the nursing pad substantially over the nipple area, the openings at all times being uncovered by the overlaying means.

28. The nursing bra as in claim 27 wherein the means connected to the bra cups comprises back and shoulder straps.

29. The nursing bra as in claim 27 wherein the means connected to the bra cups comprises a detachable back strap.

30. The nursing bra as in claim 27 wherein the means connected to the bra cups comprises shoulder straps.

31. The nursing bra as in claim 27 wherein the means connected to the bra cups comprises body adherent side tabs.

32. The nursing bra as in claim 27 in which the nursing pad comprises an inner and outer surface, wherein the outer surface is a soft, pliable, plastic like material.

33. The nursing bra as in claim 27 wherein the outer surface of each bra cup comprises a soft, pliable, plastic like material located around the perimeter of each respective opening.

34. The nursing bra as in claim 27 in which the means overlaying the inner surface of each bra cup comprises a pocket connected to each cup.

* * * * *